US009713376B2

(12) United States Patent
Christian et al.

(10) Patent No.: US 9,713,376 B2
(45) Date of Patent: Jul. 25, 2017

(54) TABLE LEVELER THAT LEVELS A TABLETOP

(71) Applicants: Steven Christian, Houston, TX (US); Ronald G Presswood, Jr., Houston, TX (US)

(72) Inventors: Steven Christian, Houston, TX (US); Ronald G Presswood, Jr., Houston, TX (US)

( * ) Notice: Subject to any disclaimer, the term of this patent is extended or adjusted under 35 U.S.C. 154(b) by 0 days.

(21) Appl. No.: 15/081,881

(22) Filed: Mar. 26, 2016

(65) Prior Publication Data

US 2016/0286952 A1 Oct. 6, 2016

Related U.S. Application Data

(60) Provisional application No. 62/140,150, filed on Mar. 30, 2015.

(51) Int. Cl.

| | |
|---|---|
| ***A47F 5/12*** | (2006.01) |
| ***A47B 13/08*** | (2006.01) |
| ***A47B 13/00*** | (2006.01) |

(52) U.S. Cl.

CPC ..... *A47B 13/081* (2013.01); *A47B 13/003* (2013.01)

(58) Field of Classification Search

CPC ..... A47B 91/02; A47B 91/16; A47B 27/02; A47B 2200/0044; F16M 11/10; F16M 11/12; F16M 11/121

USPC ..... 108/1, 4; 248/514, 515, 516, 133, 139, 248/140, 143, 371, 414, 183.2, 188.3, 248/188.2, 188.7, 920, 921, 922, 923

See application file for complete search history.

(56) References Cited

U.S. PATENT DOCUMENTS

| | | | | | |
|---|---|---|---|---|---|
| 2,893,674 | A * | 7/1959 | Monaco | A47B 11/00 | 248/183.2 |
| 3,026,159 | A * | 3/1962 | Miller | B25H 3/06 | 108/1 |
| 3,974,994 | A * | 8/1976 | Petterson | F16F 15/02 | 248/663 |
| 4,415,136 | A * | 11/1983 | Knoll | F16M 11/14 | 248/181.2 |
| 4,645,153 | A * | 2/1987 | Granzow | F16M 11/126 | 248/181.2 |
| 5,277,392 | A * | 1/1994 | Rossman | F16M 11/126 | 248/231.71 |
| 5,398,901 | A * | 3/1995 | Brodmann | A47B 81/06 | 248/181.1 |
| 5,690,303 | A * | 11/1997 | Winters | A47B 91/00 | 248/188.3 |
| 7,930,980 | B2 * | 4/2011 | Brooke | A47B 13/023 | 108/153.1 |
| 8,356,779 | B2 * | 1/2013 | Stengel | A47B 21/0073 | 248/125.1 |
| 8,640,998 | B2 * | 2/2014 | Lau | F16M 11/041 | 248/121 |
| 2003/0230681 | A1 * | 12/2003 | Gwynneth | A47B 91/16 | 248/188.3 |

(Continued)

*Primary Examiner* — Jose V Chen

(57) ABSTRACT

A table leveler fastens underneath a top of a table and adjusts a level of the top of the table. The table leveler attaches between the top of the table and a riser and includes a body with a plurality of legs that extend outwardly and attach to an underside of the top of the table. An arm pivots about the body and moves the table leveler between a locked position and an unlocked position.

20 Claims, 4 Drawing Sheets

(56) References Cited

U.S. PATENT DOCUMENTS

| | | | | |
|---|---|---|---|---|
| 2006/0000958 | A1* | 1/2006 | Li | F16M 11/18<br>248/188.3 |
| 2009/0236479 | A1* | 9/2009 | Rose | A47G 7/025<br>248/188.7 |
| 2012/0085873 | A1* | 4/2012 | Brooke | A47B 91/16<br>248/188.3 |
| 2016/0029784 | A1* | 2/2016 | Pike | A47B 91/16<br>248/188.2 |

* cited by examiner

TABLE LEVELER THAT LEVELS A TABLETOP

BACKGROUND

Tables in bars and restaurants are often moved to accommodate customer seating. After moving a table, the top of the table may no longer be level since the floor on which the table rests may not be level. If the top of the table is not level, then it can cause an inconvenience or annoyance to customers sitting at the table.

Tables can also be moved to abut against each other and create a larger seating and serving area for customers. Often, ends of abutting tables, however, do not align since a top of one table is higher than a top of the other table. This situation creates a ledge or drop-off where food and other things can fall over, break, or spill, which can also cause an inconvenience or annoyance to customers sitting at the table.

SUMMARY OF THE INVENTION

Figure 1:
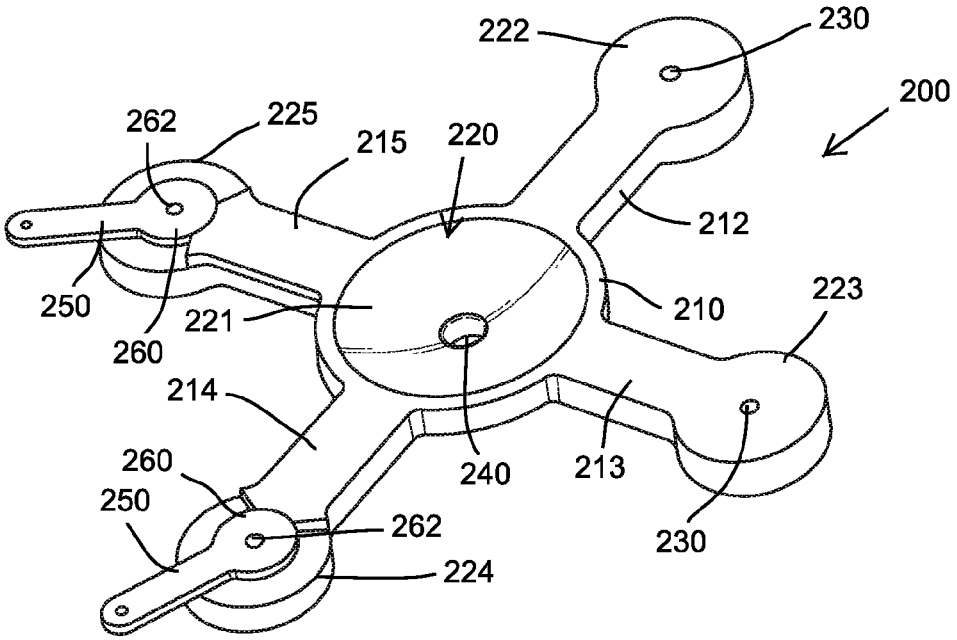
FIG. 1 shows a table leveler in accordance with an example embodiment.

One example embodiment is a table leveler that fastens underneath a top of a table and adjusts a level of the table. The table leveler includes a lever and a body with a plurality of legs that extend outwardly from the body. The lever moves between a locked position in which the table leveler locks the top of the table to a riser and an unlocked position in which the table leveler unlocks the top of the table from the riser. In the unlocked position, the level or tilt of the top of the table can be adjusted.

Other example embodiments are discussed herein.

DETAILED DESCRIPTION

Example embodiments relate to methods and apparatus that use a table leveler to move and level a top of a table.

As noted in the Background section, the top of a table may no longer be level after it is moved or after it is placed on the floor since the floor itself may not be level. Additionally, ends of abutting tables may not align since a top of one table is higher than or lopsided with a top of the other table. Example embodiments solve these problems and other problems associated with leveling a top of a table.

One example embodiment is a table leveler that fastens underneath a top of a table and connects to a top of a riser or support that connects to a base of the table. The table leveler includes a square or circular body with a lever or arm and a plurality of legs that extend outwardly from the body. The lever moves between a locked position in which the table leveler locks the top of the table to the riser and an unlocked position in which the table leveler unlocks the top of the table from the riser. In the unlocked position, the level or tilt of the top of the table can be adjusted.

By way of example, the body of the table leveler includes one of a convex or concave shape that rests in or engages with a complimentary convex or concave shape at an end of the riser. As such, the table leveler can move or float when it is in the unlocked position. For instance, the table leveler engages the riser in a ball and socket configuration. In the unlocked position, the ball and socket are moveable to adjust a tilt or level of the top of the table (also known as a tabletop).

People can use the table leveler to adjust a level or angle of tilt of the top of the table without using any tools, such as a screwdriver, wrench, hammer, or other tool. Further, people can adjust the level of the top of the table without kneeling or lying on the floor, without being required to look under the top of the table, or without bending down. The level of the table can be readily adjusted while standing or sitting next to the table by moving an arm or lever of the table leveler that is positioned under the top of the table and near the riser.

With example embodiments, people (such as customers or staff in a bar or restaurant) can easily move a top of a table and adjust its levelness. Example embodiments thus provide people with a quick, convenient, and easy way to adjust or change a level of a top of a table.

FIG. 1 shows table leveler 200 in accordance with an example embodiment. Table leveler 200 includes a body 210 with four legs 212, 213, 214, and 215 extending outwardly from and integrally formed with the body 210. The body has a round or dome shape that forms a partial spherical or concave cavity 220 with a smooth inner surface 221. The legs have an elongated rectangular shape with a rounded or bone-shaped end 222, 223, 224, and 225. Ends of one or more of the legs include an opening 230 to receive a screw, rivet, nail, or other fastener to attach the table leveler to an underside of a top of a table. The body 210 includes a hole 240 that receives and connects to a riser or support of the table (shown in FIG. 4). The flat side of the legs seats against the underside of the top of the table.

Two of legs 214 and 215 include a lever or arm 250 that adjusts a tilt or angle of the top of the table. The lever 250 has an elongated shape with a round end 260 with a hole and fastener 262 that connects to an end of the leg. The lever is movable or rotatable to adjust the tilt or angle of the table.

Figure 2:
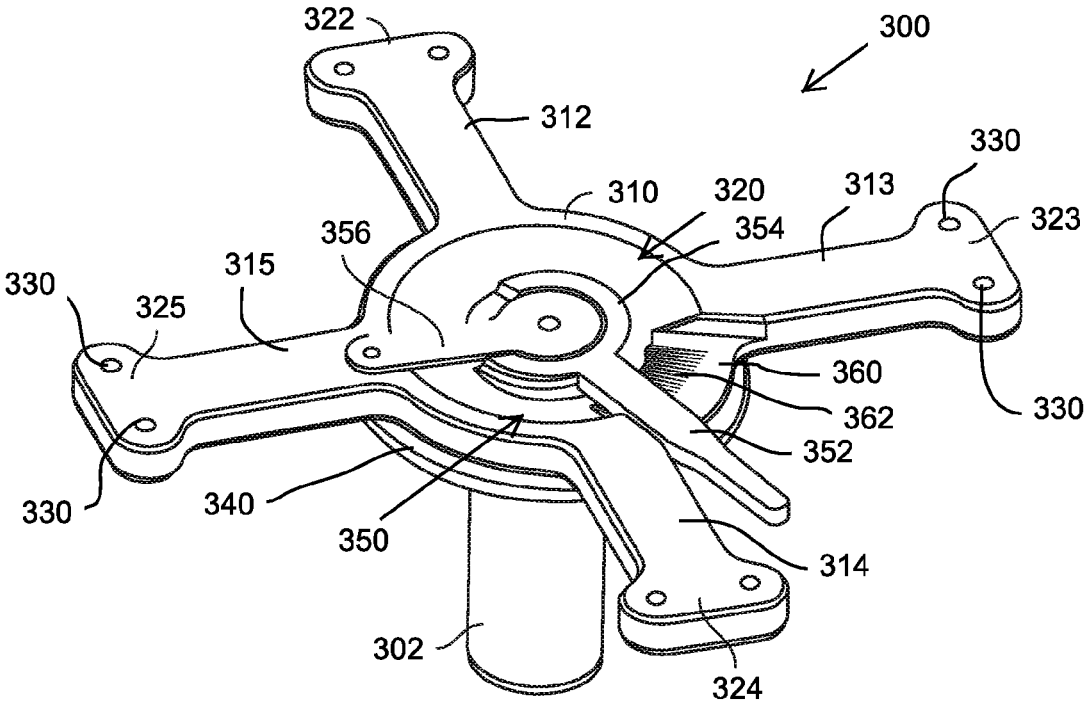
FIG. 2 shows a table leveler attached to a riser of a table in accordance with an example embodiment.

FIG. 2 shows a table leveler 300 attached to a riser 302 of a table in accordance with an example embodiment. Table leveler 300 includes a body 310 with four legs 312, 313, 314, and 315 extending outwardly from and integrally formed with the body 310. The body has a round or dome shape that forms a partial spherical or concave cavity 320 on one side and a corresponding convex cavity on the other side. The legs have an elongated rectangular shape with a rounded or bone-shaped end 322, 323, 324, and 325 and a flat side that seats against or engages the underside of the top of the table. Ends of the legs include two openings 330 to receive a screw, rivet, nail, or other fastener to attach the table leveler to the underside of a top of a table.

The riser 302 (also known as a support) connects a base of the table to the top of the table or tabletop. The riser has a convex shaped end 340 that matches or fits within a concave shaped cavity 320 of the body 310 such that table leveler moves with respect to the riser in order to adjust a tilt or angle of the top of the table. For example, the table leveler (and table top to which the table leveler is attached) moves with a ball-and-socket configuration with the end of the riser.

The table leveler 300 includes a locking mechanism 350 that locks and unlocks the table leveler to the end of the riser in order to lock and unlock the table leveler from the riser and hence adjust the top of the table. The locking mechanism includes an arm or lever 352 with a C-shaped end 354 that rotates about a cylindrical end of a second arm or stop 356. A ramped, curved, or inclined surface 360 includes a plurality of ridges or indentations 362 into which the lever 352 engages.

The lever 352 is movable between an unlocked position (shown in FIG. 2) and a locked position. In the unlocked position, the lever 352 seats against or abuts a side of leg 314. In the locked position, the lever 352 seats against or abuts a side of leg 313. When the lever is in the unlocked position, the table leveler disengages or unlocks from the riser such that the table leveler can move (e.g., similar to movements of a ball-and-socket). When the lever is in the locked position, the table leveler clamps against or forcibly engages or presses against the riser such that the table leveler cannot move with respect to the riser. The ridges 362 assist in maintaining the lever 352 in a position between the locked and unlocked positions.

FIGS. 3A-3D show a table leveler 400 attached to a riser 402 in accordance with an example embodiment. Table leveler 400 includes a body 410 with four legs 412, 413, 414, and 415 extending outwardly from and integrally formed with the body 410. The body has a round or dome shape that forms a partial spherical or convex cavity 420. The legs have an elongated rectangular shape with a rounded or bone-shaped end 422, 423, 424, and 425 and a flat side that seats against or engages the underside of the top of the table. Ends of the legs include two openings 430 to receive a screw, rivet, nail, or other fastener to attach the table leveler to the underside of a top of a table.

An elongated lever 440 includes a rounded end with a hole 442 through which a fastener or rod 444 pivotally connects the lever to the body 410. The body 410 also includes a channel 450 to enable the lever to move between an unlocked position (shown in FIGS. 3A-3D) and a locked position.

The riser 402 includes a column 460 with a cup-shaped, bowl-shaped, or partial spherical end with a concave surface 462 that interfaces or engages with the convex surface 464 of the body 410 of the table leveler.

A locking mechanism 470 enables the table leveler to move between a locked and unlocked position. In the locked position, the table leveler locks against the riser and cannot be moved or adjusted. In the unlocked position, the table leveler unlocks against the riser and can be moved or adjusted to change a level, tilt, or angle of the top of the table.

Figure 3A:
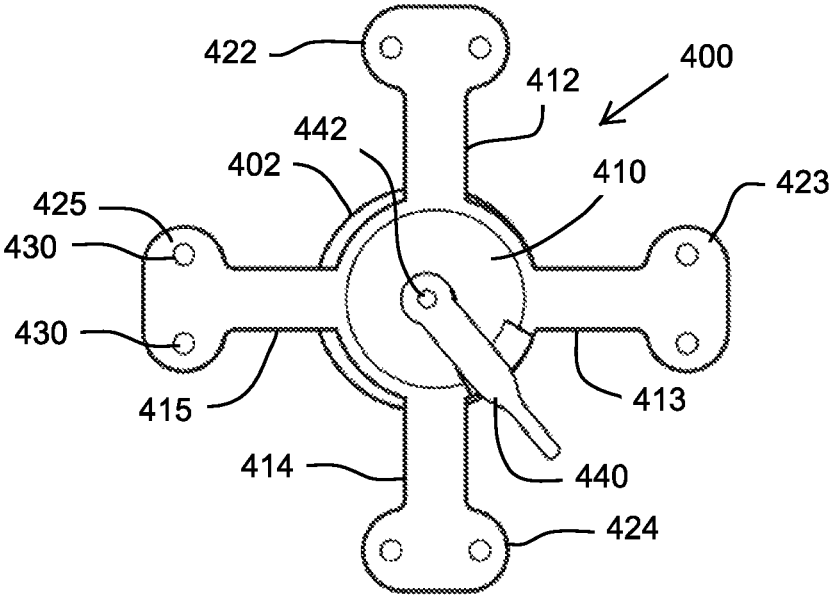
FIG. 3A shows a top view of a table leveler attached to a riser in accordance with an example embodiment.
Figure 3B:
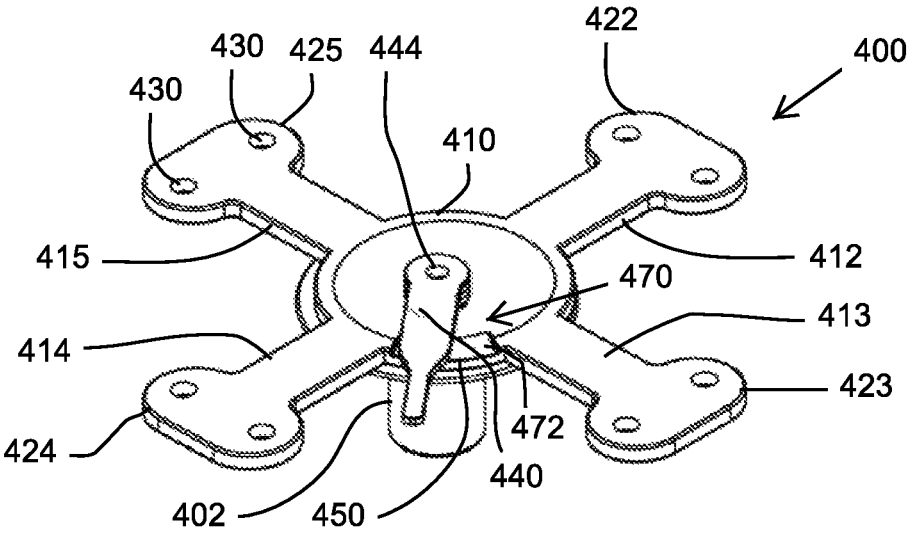
FIG. 3B shows a perspective view of the table leveler attached to the riser in accordance with an example embodiment.
Figure 3C:
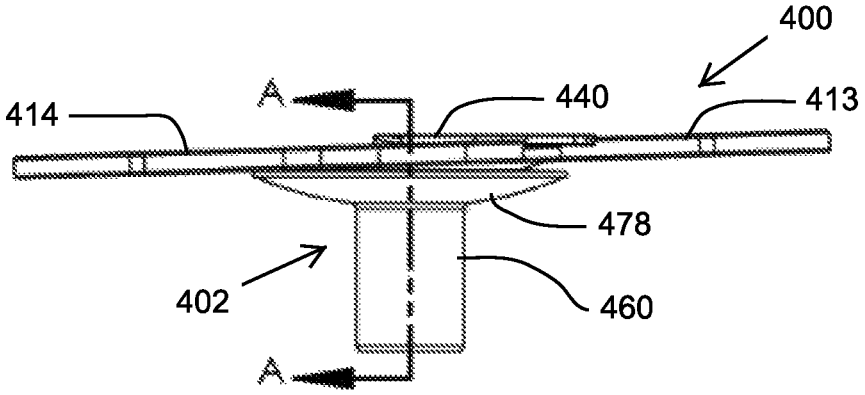
FIG. 3C shows a side view of the table leveler attached to the riser in accordance with an example embodiment.
Figure 3D:
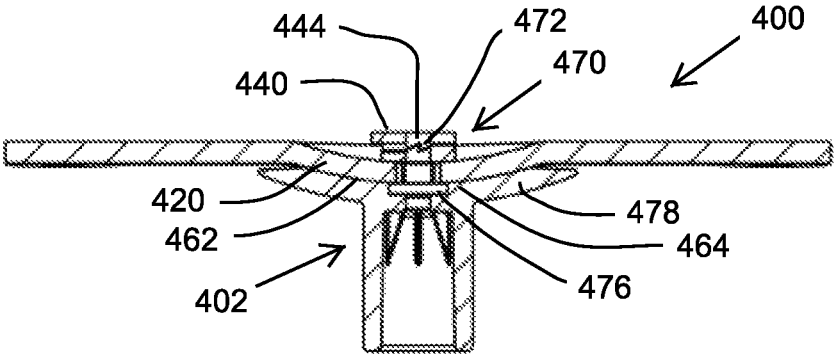
FIG. 3D shows a cross-sectional view taken along line A-A of FIG. 3C of the table leveler attached to the riser in accordance with an example embodiment.

As best shown in FIG. 3D, the locking mechanism 470 includes a ridge or ledge 472 into which the lever 440 moves between the locked and unlocked positions. In the locked position, a washer, nut, or other device 476 forcibly seats against a wall 478 of the riser. In the unlocked position, this device 476 unseats or loosens so the riser and table leveler can be moved with respect to each other as the lever 440 rotates about pin 444.

Figure 4:
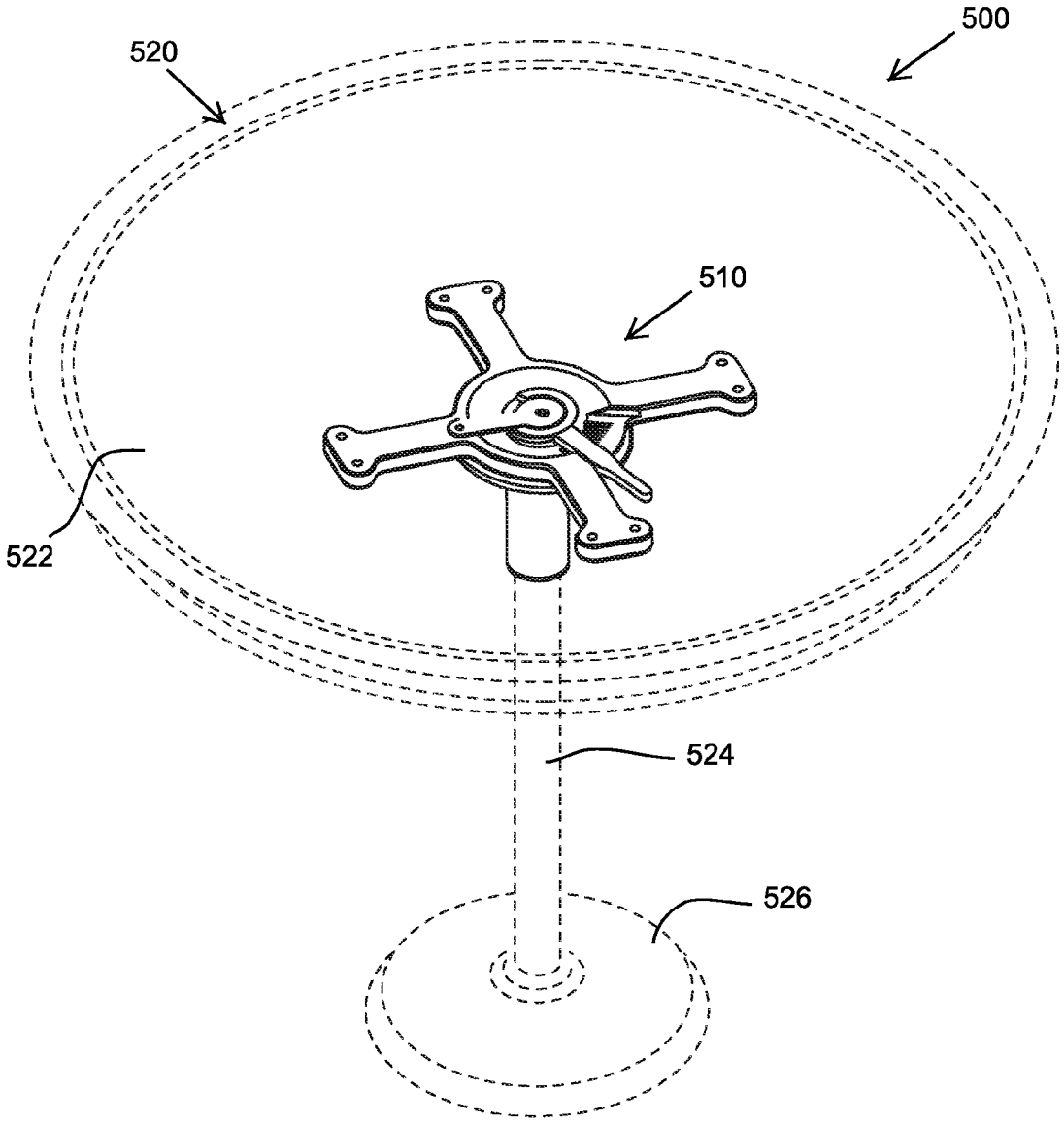
FIG. 4 shows a table assembly that includes a table leveler attached to a table in accordance with an example embodiment.

FIG. 4 shows a table assembly 500 that includes a table leveler 510 (such as a table leveler in accordance with an example embodiment) and a table 520 (shown in dashed lines).

The table includes a tabletop 522, a riser or support 524, and a base 526. The riser extends between and attaches to the tabletop and the base that sits on the floor. By way of illustration, the table leveler 510 is similar to the table leveler 300 shown in FIG. 2.

The table leveler can have different shapes, such as a spider-shape, star-shape, or other shape with a body and three or more legs extending outwardly therefrom. Further, the legs can be equally spaced around the body and have different shapes, such as elongated rectangular, cylindrical, square, rounded, or another shape.

One example embodiment is a method that uses a table leveler to adjust a tilt or position of a tabletop of a table. The table is provided with a base, the tabletop, and a column or riser that extends between the base and the tabletop. The tabletop can have various shapes and sizes (such as square, rectangular, circular, etc.).

The table leveler is provided with a body located in a center of the table leveler. This body can have various shapes, such as round, circular, disc, square, rectangular, or other shape. Further, the body includes three, four, or more elongated legs that extend outwardly from the body. Distal ends of the legs attach to an underside of the tabletop along one flat side of the table leveler.

The table leveler includes an arm, lever, latch, or locking mechanism that unlocks the table leveler from the riser. For example, a lever has one end that pivotably or rotatably attaches to the body of the table leveler. A second end moves between two of the legs from a locked position to an unlocked position. In the locked position, the table leveler locks the tabletop so that the tilt or angle of the tabletop is not movable. In the unlocked position, the table leveler unlocks from the riser while staying attached to the bottom of the top of the table. In the unlocked position, the tabletop is moveable in order to adjust or move the tilt or angle of the tabletop.

An end of the riser or support has a curved shape that complements, matches, or emulates a curved shape of one side of the table leveler. For example, the end of the riser has a convex or concave shape, and the side of the table leveler has concave or convex shape that forms a ball and socket engagement or connection with the riser. In the unlocked position, the table leveler freely moves with respect to the riser so the level or angle of the tabletop can be moved and adjusted.

The table leveler can be manufactured from steel, metal, polymers, plastics, wood, composite materials, recycled materials or fibers (including fiber board), and combinations thereof. For example, the table leveler is made by injection molding, vacuum molding, or another method.

The methods and apparatus in accordance with example embodiments are provided as examples, and examples from one method or apparatus should not be construed to limit examples from another method or apparatus. Further, methods and apparatus discussed within different figures can be added to or exchanged with methods and apparatus in other figures. Further yet, specific numerical data values (such as specific quantities, numbers, categories, etc.) or other specific information should be interpreted as illustrative for discussing example embodiments.

What is claimed is:

1. A table assembly, comprising:

a table with a base that sits on a floor, a tabletop, and a riser that extends between the base and the tabletop and includes an end with a convex surface; and a table leveler with a circular body having a concave surface that engages and rotates in the convex surface of the riser, with four legs that extend outwardly from the circular body such that the four legs have a first end integrally formed to the circular body and a second end fastened to a bottom side of the tabletop, and with a locking mechanism that includes a lever with a first end that pivotally attaches to the circular body and a second end that extends outwardly from the circular body;

wherein the lever rotates between a first position that locks the tabletop to the riser and prevents the tabletop from moving and a second position that unlocks the tabletop from the riser so the concave surface rotates in the convex surface of the riser in order to move and level the tabletop, wherein the lever presses against the riser and forces the concave surface of the table leveler against the convex surface of the riser to prevent movement of the table leveler with respect to the riser in the first position.

2. The table assembly of claim 1, wherein the table leveler has spider-shape.

3. The table assembly of claim 1, wherein the four legs are equally spaced apart around the circular body.

4. The table assembly of claim 1, wherein the four legs have a body with a rectangular shape.

5. The table assembly of claim 1, wherein the second end of each of the four legs includes a hole to receive a fastener to connect the table leveler to the bottom side of the tabletop.

6. The table assembly of claim 1, wherein the first end of the lever has a round shape that pivotally attaches to the circular body and rotates about a pin.

7. The table assembly of claim 1, wherein the first end of the lever has a hole with a pin that pivotally attaches the lever to the circular body.

8. The table assembly of claim 1, wherein the circular body includes a channel in which the lever rotates from the first position at one end of the channel to the second position at another end of the channel, wherein the tabletop can be moved and leveled when the lever is in the second position but not in the first position.

9. A method that uses a table leveler to adjust a tilt of a tabletop of a table, the method comprising:

providing the table with a base, the tabletop, and a column that extends between the base and the tabletop;

providing the table leveler with a round body located in a center of the table leveler, with four elongated legs that extend outwardly from the round body with distal ends of the four legs attached to an underside of the tabletop, and with a lever having one end that rotatably attaches to the round body;

providing the lever movable to a lock position in which the lever clamps against the column of the table and forces the table leveler against an end of the column to lock the tabletop to the column so that the tilt of the tabletop is not movable; and providing the lever movable to an unlock position in which the table leveler unlocks the tabletop from the table leveler so that the tilt of the table is moveable such that a concave end of the column rotates within a convex side of the round body in order to move and to adjust the tilt of the tabletop.

10. The method of claim 9 further comprising:

providing the table leveler with a star shape.

11. The method of claim 9 further comprising:

providing the four legs to be equally spaced apart from around the round body of the table leveler.

12. The method of claim 9 further comprising:

providing the concave end of the column with a size that matches a size of the convex side of the round table.

13. The method of claim 9 further comprising:

providing the round body in a center of the table leveler.

14. The method of claim 9 further comprising:

providing the distal ends of each of the four legs with two holes that receives screws to attach the table leveler to the underside of the tabletop.

15. The method of claim 9 further comprising:

providing the distal ends of the four legs with a bone shape.

16. A table assembly, comprising:

a table with a base that sits on a floor, a tabletop, and a support that extends between the base and the tabletop and includes an end with one of a convex surface or a concave surface; and a table leveler with a first side having a flat surface that engages a bottom side of the tabletop, with a second side having body with one of a convex surface or a concave surface that rotatably engages the one of the convex surface or concave surface of the end of the support, with a plurality of legs that are equally spaced apart and that extend outwardly from the body such that each of the plurality of legs has a first end integrally formed to the body and a second end fastened to the bottom side of the tabletop, and with a locking mechanism that includes an elongated arm with a first end that pivotally attaches with a pin to the body and a second end that extends outwardly from the body;

wherein the arm moves between a first position that locks the tabletop to the support and prevents the tabletop from moving and a second position that unlocks the tabletop from the support to change a tilt of the tabletop by enabling rotation of the one of the convex surface or the concave surface of the end of the support with the one of the convex surface or concave surface of the end of the body of the table leveler, wherein the arm presses against the support and forces the one of the convex surface of the concave surface of the table leveler against the one of the convex surface or the concave surface of the support to prevent movement of the table leveler with respect to the support in the first position.

17. The table assembly of claim 16, wherein the table leveler has a star shape with four legs that extend outwardly from the body.

18. The table assembly of claim 16, wherein the body has a disc shape with a flat side and an oppositely disposed convex side.

19. The table assembly of claim 16, wherein the body has a round shape with a channel with an arc shape, and the arm slides within the channel.

20. The table assembly of claim 16, wherein the body has a dome-shape with a cavity on one side.

* * * * *